US006216291B1

(12) United States Patent
Eads et al.

(10) Patent No.: US 6,216,291 B1
(45) Date of Patent: Apr. 17, 2001

(54) ENCLOSURE BED APPARATUS

(75) Inventors: Norman Eads; Barry Bearden, both of Houston, TX (US)

(73) Assignee: Safe-T-Care Manufacturing Co., Inc., Houston, TX (US)

( * ) Notice: Subject to any disclaimer, the term of this patent is extended or adjusted under 35 U.S.C. 154(b) by 0 days.

(21) Appl. No.: 09/503,472

(22) Filed: Feb. 14, 2000

(51) Int. Cl.[7] ..... A61G 7/05; A47C 21/08

(52) U.S. Cl. ..... 5/424; 5/414; 5/658; 5/600; 135/96; 135/121

(58) Field of Search ..... 5/424, 414, 658, 5/600, 97, 98.1; 135/96, 121, 157

(56) References Cited

U.S. PATENT DOCUMENTS

| | | | |
|---|---|---|---|
| D. 231,874 | 6/1974 | Weigel et al. | D6/14 |
| 654,972 | 7/1900 | Haack | 135/157 |
| 875,206 | 12/1907 | Osborne | 135/157 |
| 1,021,930 | 4/1912 | Jackson | 135/96 |
| 2,350,618 | 6/1944 | Johnson . | |
| 4,641,387 | 2/1987 | Bondy et al. | 5/97 |
| 4,852,598 | 8/1989 | Griesenbeck | 5/414 |
| 5,384,925 | 1/1995 | Vail | 5/424 |
| 5,784,732 | 7/1998 | Vail | 5/424 |

*Primary Examiner*—Alexander Grosz
(74) *Attorney, Agent, or Firm*—Harrison & Egbert

(57) ABSTRACT

An enclosure bed apparatus including a bed having a mattress supported on a bed frame, and wheels rotatably supported at a bottom thereof so as to rollably support the mattress on a floor, an enclosure frame extending over the mattress and having a lower portion affixed to the bed frame such that a bottom of the legs is supported a distance above the floor, and an enclosure affixed to the enclosure frame so as to extend over and around the mattress. A clamp is used so as to connect the lower portion of the enclosure frame to the bed frame. The enclosure has a top and a plurality of side walls and a bottom. The bottom of the enclosure is interposed between the mattress and the bed frame. The top of the enclosure extends over and around the upper structure of the enclosure frame.

14 Claims, 5 Drawing Sheets

ENCLOSURE BED APPARATUS

TECHNICAL FIELD

The present invention relates to enclosure beds. More particularly, the present invention relates to frames of end bars that are adapted for attachment to the frame of the hospital bed.

BACKGROUND ART

In medical treatment situations, it is sometimes necessary to physically restrain certain patients in order to provide protection for themselves and/or others. For example, adults and children having dementia, psychiatric or mental disorders, or other kinds of physical and/or mental problems may need to be restrained. In the past, these people have been physically restrained by using ties, straps or vests. However, the use of these kinds of restraints can cause severe discomfort and can impede emergency treatment. In addition, these kinds of restraints must frequently be removed during the day for a variety of reasons, such as to allow the person to exercise his or her muscles, or to clean or feed the person.

One alternative to using physical restraints involves the use of an enclosure bed. Typically, the enclosure bed includes a supporting framework and a knitted covering which is fitted over the sides and the top of the framework. The knitted covering is provided with zippered areas which can be readily opened and closed in order to provide access to the interior of the enclosure. Thus, the enclosure bed provides a more humane, safe and less restrictive environment for the person.

Unfortunately, a major problem with the use of such enclosure beds is the inability to move the enclosure bed after it is installed. Typically, specialized personnel must be called in so as to move the enclosure bed. In certain circumstances, the enclosure bed must be disassembled so that the hospital bed (on the interior of the enclosure bed) can be moved. In other circumstances, in order to move a patient from the enclosure bed to another location, the patient would have to be lifted and transferred to a mobile bed. The difficulty in actually moving the enclosure bed has discouraged the use of such enclosure beds.

In the past, various U.S. patents have issued relating to such enclosure beds. For example, U.S. Pat. No. 4,641,387, issued on Feb. 10, 1987 to Bondy et al., teaches an enclosure for a bed which provides protection for patients. The enclosure is formed of a supporting framework and an associated covering provided with suitably arranged zippered areas for achieving access to the patient from the exterior of the enclosure. The frame of the enclosure bed has a rectangular structure which is designed so as to rest flatly upon a floor.

U.S. Pat. No. 5,384,925, issued on Jan. 31, 1995, to R. L. Vail, teaches an improved bed enclosure which is provided with a unique supporting structure which increases the vertical stability of the bed enclosure. The bed enclosure includes a frame having at least four upright side posts, each including an upper portion and a lower portion. The frame also includes upper frame support members interconnecting the upper portions of the side posts together and lower frame support members interconnecting the lower portions of the side posts together. The frame defines a pair of generally vertical side walls of a predetermined length and a pair of opposing end walls of a predetermined width. At least one support leg associated with each of the side walls is secured to the lower portion of the side posts and is engageable with the floor at a point spaced outwardly from the respective side wall. A bar extends in a horizontal orientation so as to rest flatly upon the floor.

U.S. Pat. No. 5,784,732, issued on Jul. 28, 1998 to R. L. Vail describes another type of bed enclosure which is provided with a side rail which is movably mounted to the frame of the bed enclosure by a hinge assembly. The bed enclosure includes side posts having bottoms which support the enclosure directly upon the floor. The hospital bed is retained on the interior of the bed enclosure. The wheels of the hospital bed will reside independently upon the same floor upon which the bottoms of the side posts reside.

It is an object of the present invention to provide an enclosure bed which is mobile with the hospital bed.

It is another object of the present invention to provide an enclosure bed that can be easily assembled and disassembled.

It is a further object of the present invention to provide an enclosure bed which does not require specialized labor for movement or assembly.

It is still another object of the present invention to provide an enclosure bed which facilitates the ability to install the mattress within the enclosure.

It is still a further object of the present invention to provide an enclosure bed which has a lower frame adapted to be connected to a standardized hospital bed frame.

These and other objects and advantages of the present invention will become apparent from a reading of the attached specification and appended claims.

SUMMARY OF THE INVENTION

The present invention is an enclosure bed apparatus comprising a bed having a mattress supported on a bed frame, an enclosure frame extending over the mattress, an enclosure affixed to the enclosure frame so as to extend over and around the mattress. The bed frame has wheels rotatably connected at a bottom thereof so as to rollably support the mattress on a floor. The enclosure frame has a lower portion and legs. The lower portion is affixed to the bed frame such that a bottom of the legs is supported a distance above a bottom of the wheels and above the floor.

In the present invention, a clamp is connected to the lower portion of the enclosure frame. The clamp engages the bed frame at an area below the mattress and above the wheels. The lower portion of the enclosure frame comprises a lower structure connected to the legs and has a generally rectangular configuration. In particular, this lower structure includes cross members affixed respectively to legs at opposite ends of the frame, and longitudinal members affixed respectively to the cross members and extending therebetween in a generally parallel relationship. Each of the longitudinal members comprises a pair of end sections affixed to respective cross members and extending inwardly therefrom and a central section affixed to the pair of end sections and overlying at least a portion of the end sections. The clamp includes a pair of clamps which are connected to the central section and have a portion extending downwardly therefrom. This portion extending downwardly is adapted to be secured to the bed frame. In particular, each of the clamps has a generally L-shaped configuration with a threaded end. A nut is engaged with the threaded ends so as to compressively secure the bed frame against the central section of the longitudinal members.

In the present invention, the enclosure is a canopy having a plurality of side walls and a bottom and a top interconnected together. The top extends over an upper structure of the enclosure frame. The plurality of side walls are affixed to the legs and extend respectively therebetween in generally vertical planes. The bottom extends between the legs and above the lower portion of the enclosure frame. In particular, the bottom is interposed between the mattress and the bed frame. Each of the plurality of side walls has a netting in zippered connection with a remainder of the side wall. At least one of the side walls has a zippered slit opening on an exterior surface of the side wall so as to allow access to the three-dimensional interior space within the enclosure.

DETAILED DESCRIPTION OF THE INVENTION

Figure 1:
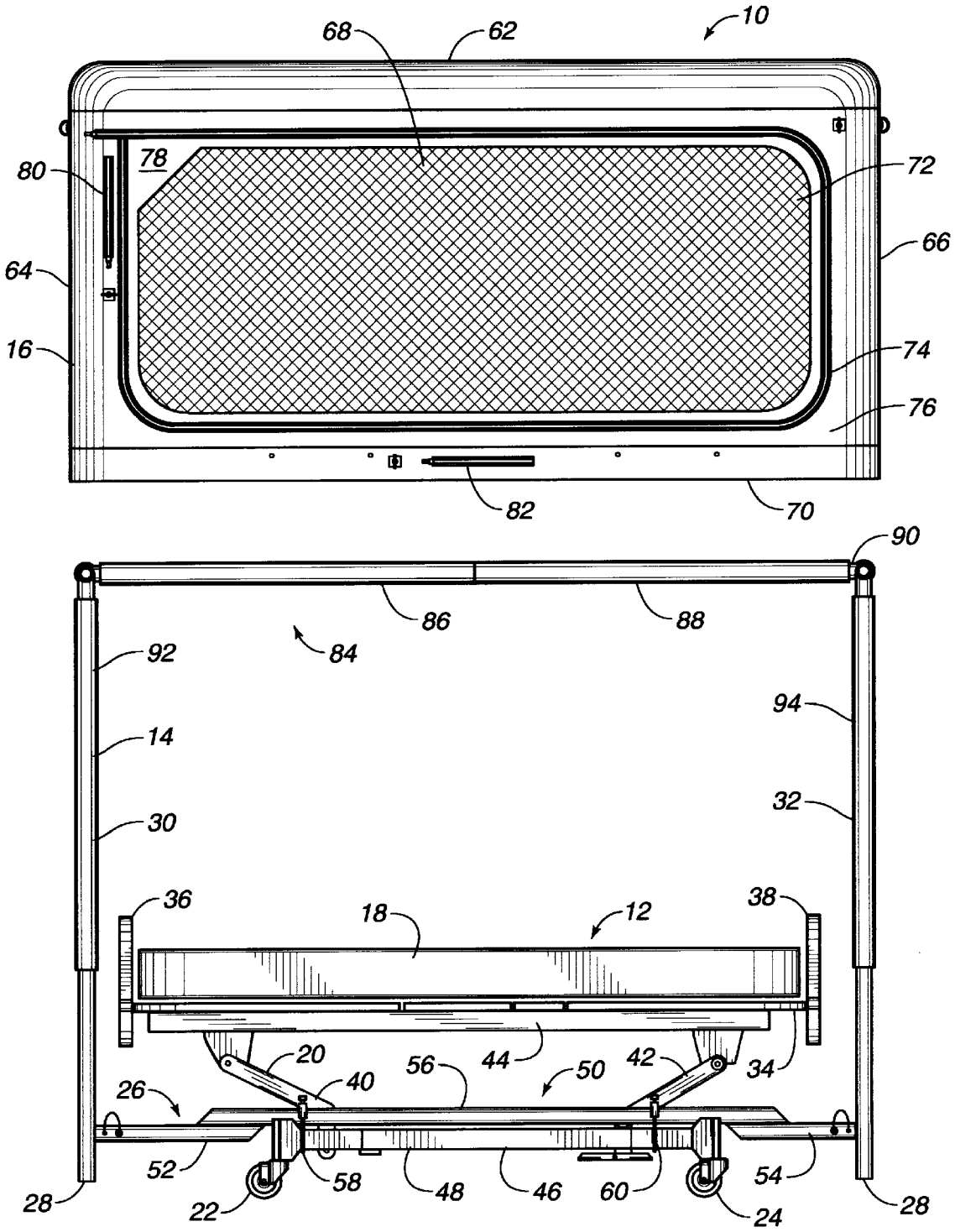
FIG. 1 is a side elevational partially exploded view of the enclosure bed in accordance with the present invention.

Referring to FIG. 1, there is shown the enclosure bed apparatus 10 in accordance with the teachings of the present invention. The enclosure bed apparatus 10 includes a bed 12, an enclosure frame 14 and an enclosure 16. The bed 12 includes a mattress 18 supported on a bed frame 20. Wheels 22 and 24 are rotatably mounted to a bottom of the bed frame 20 so as to rollably support the mattress 18 on a floor. The enclosure frame 14 extends over the mattress 18. The enclosure frame 14 has a lower portion 26 that is affixed to the bed frame 20 such that a bottom 28 of the legs 30 and 32 of the enclosure frame 14 are supported a distance above the bottom of the wheels 22 and 24 and above the floor. Enclosure 16 is affixed to the enclosure frame 14 so as to extend over and around the mattress 18.

As shown in FIG. 1, the bed 12 is a hospital bed of a standard configuration. This hospital bed 12 is commonly known as a Trendelenburg bed. The mattress 18 is typically placed on a flat surface 34 between the base board 36 and the head board 38. Pivotal linkages 40 and 42 are connected to the upper frame 44 of hospital bed 12 so as to manipulate and adjust the position of the patient on the bed 12. Suitable pivotal movement of the linkages 40 and 42 can cause the head board 38 or the base board 36 to move upwardly and downwardly. Linkages 40 and 42 are pivotally connected to bottom frame 46. Bottom frame 46 is rotatably connected to wheels 22 and 24. The bottom frame 46 includes a horizontal bar 48 onto which the lower portion 26 of the enclosure frame 14 is connected.

As can be seen in FIG. 1, the lower portion 26 of the enclosure frame 14 includes a longitudinal member 50 extending between legs 30 and 32. Longitudinal member 50 includes end sections 52 and 54 and central section 56. The ends of the central section 56 will overlie the inward ends of the end sections 52 and 54. As such, the central section 56 is particularly adapted so as to be placed onto the horizontal bar 48 of the bottom frame 46 of hospital bed 12. Clamps 58 and 60 are connected to the central section 56 and will engage the horizontal bar 48 of the bottom frame 46 of hospital bed 12 so that the enclosure frame 14 is fixedly secured onto the bed frame 20 of hospital bed 12.

As can be seen in FIG. 1, since the bottoms 28 of the respective legs 30 and 32 are located above the bottom of the wheels 22 and 24, the enclosure frame 14 can be moved, along with the hospital bed 12, to a desired location. A close proximity of the bottoms 28 to the floor upon which the wheels 22 and 24 roll assures the structural stability of the enclosure frame 14 in the event of unusual forces being placed upon the enclosure frame 14 by a patient within the enclosure 16.

The enclosure 16 has a top 62, side walls 64, 66 and 68 and a bottom 70. The opposite side walls of side wall 68 is not shown in FIG. 1. The top 62, the side walls 64, 66 and 68, and the bottom 70 are securely interconnected together. In normal use, the bottom 70 will be interposed between the mattress 18 and the upper frame 44 of hospital bed 12.

As can be seen in FIG. 1, the side wall 68 includes a netting 72 which is secured by zipper 74 to the remainder 76 of side wall 68. Zipper 74 is positioned around the side wall 68 so as to allow for the easy attachment and removal of the netting 72, as desired. For example, if it is necessary to completely replace, to wash or to repair the netting 72, the zipper 74 can simply be unzipped, around its periphery, so as to allow the easy removal of the netting 72. A 45 degree tapered area 78 is positioned at one corner of the netting 72 so as to prevent access to the flap of the zipper 74, by the patient on the interior of the enclosure 16.

In FIG. 1, it can be seen that zippered slits 80 and 82 are formed in the side wall 68. Zippered slits 80 and 82 can be suitably manipulated so as to allow access to the three-dimensional interior of the enclosure 16. As such, if necessary, IV bags can be connected to a patient on the interior of the enclosure 16 through the zippered slits 80 and 82.

In normal installation, the top 62 will reside over the upper structure 84 of enclosure frame 14. The side walls 64, 66 and 68 will reside around the legs 30 and 32 of the enclosure frame 14 and extend in a generally vertical plane around the sides and ends of the enclosure frame 14.

In FIG. 1, it can be seen that Styrofoam tubes 86 and 88 are placed over and around the side bar 90 of the upper structure 84 of enclosure frame 14. Similarly, a Styrofoam tube 92 is placed over and around the leg 30 of the enclosure frame 14. Another Styrofoam tube 94 is placed over and around the leg 32. The Styrofoam tubes 86,88,92 and 94 will reside on the interior of the enclosure 16 and will serve to prevent injury to the patient.

Figure 2:
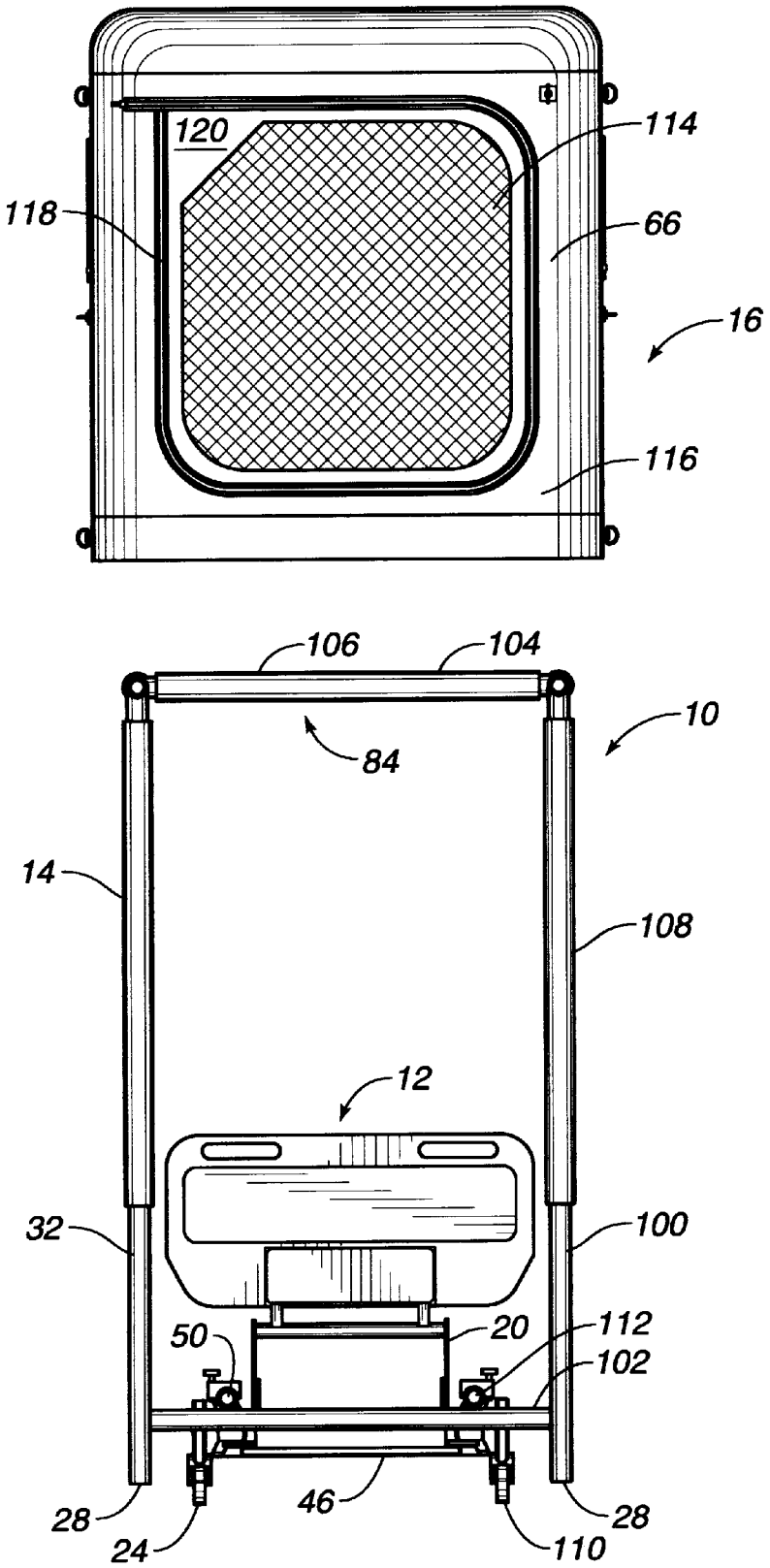
FIG. 2 is a partially exploded end view showing the enclosure bed in accordance with the preferred embodiment of the present invention.

FIG. 2 is an end view of the enclosure bed apparatus 10 of the present invention. In FIG. 2, it can be seen that the hospital bed 12 resides between the legs 32 and 100 of the enclosure frame 14. Also, it can be seen that a cross member 102 extends between the legs 32 and 100. An end bar 104 will extend between legs 32 and 100 at the upper structure 84 of the enclosure frame 14. A Styrofoam tube 106 extends around the end bar 104. A Styrofoam tube 108 extends around the leg 100. Importantly, it can be seen that the bottoms 28 of legs 32 and 100 reside above the bottoms of the wheels 24 and 110 of the hospital bed 12.

The enclosure frame 14 is secured to the frame 20 of the hospital bed 12 by affixing the longitudinal members 50 and 112 to the bottom frame 46 of the hospital bed 12. A more detailed explanation as to how this connection is made will be found hereinafter.

The enclosure 16 shows its side wall 66. Side wall 66 includes a netting 114 which is secured to the remainder 116 of the side wall 66 through the use of zipper 118. An tapered area 120 is formed on the side wall 66 so as to prevent access to the flap of the zipper 118 by a patient on the interior of the enclosure 16.

Figure 3:
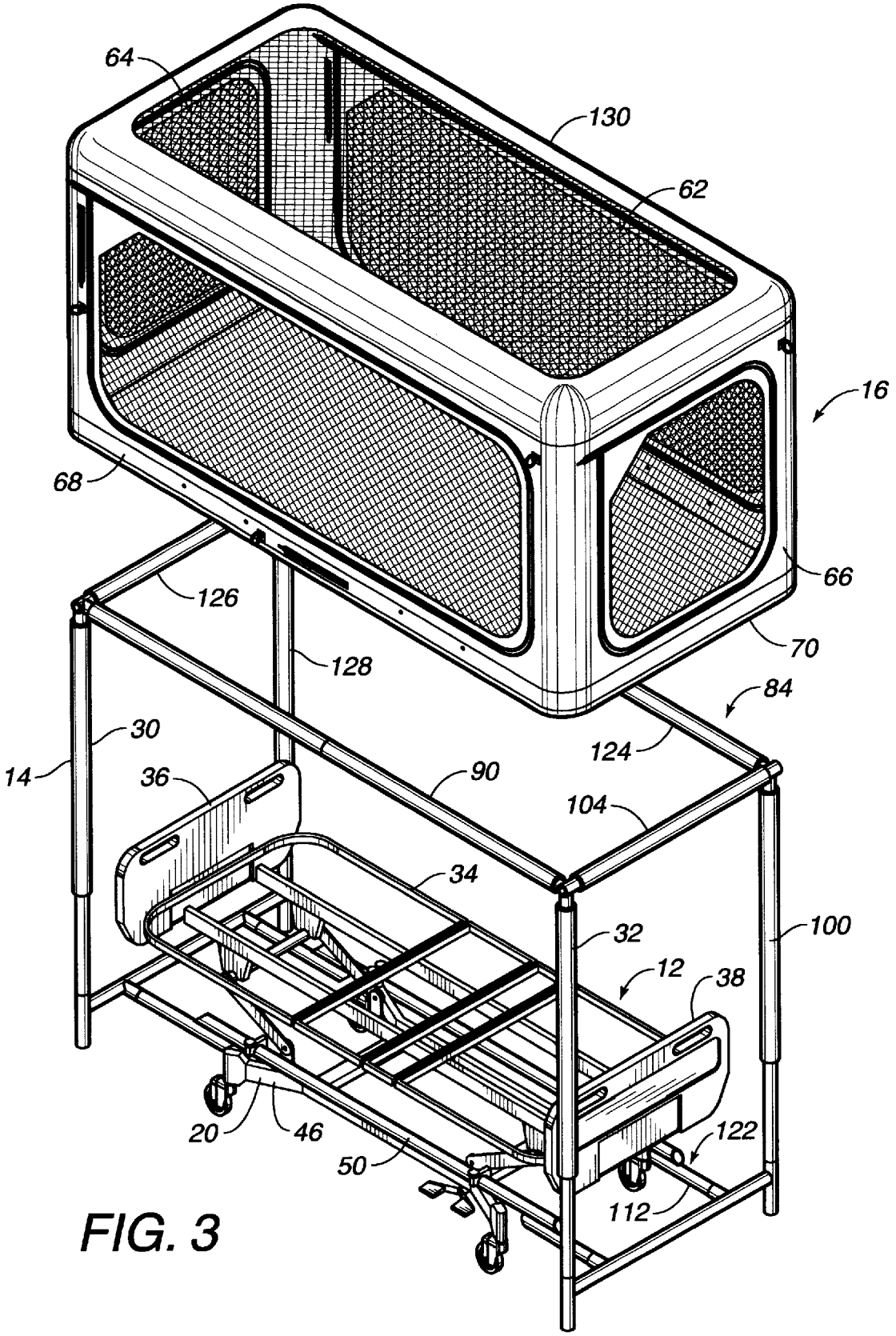
FIG. 3 is a partially exploded upper perspective view showing the enclosure bed in accordance with teachings of the present invention.

FIG. 3 shows the manner in which the enclosure frame 14 is secured to the frame of the hospital bed 12. In particular, the longitudinal member 50 is clamped onto the bottom frame 46 of the hospital bed 12. Another longitudinal member 112 is secured to a corresponding portion of the frame 20 of hospital bed 12. The enclosure frame 14 shows its upper structure 84 as having side bars 90 and 124 and end bars 104 and 126 arranged in a generally rectangular configuration. Legs 30, 32, 128 and 100 extend downwardly from this upper structure 84. The top 62 of the enclosure 16 will reside over the upper structure 84. Side wall 66 will reside in a vertical plane between the legs 32 and 100. Side wall 68 will reside in a vertical plane between the legs 30 and 32. Opposite side wall 64 will reside in a vertical plane between legs 14 and 128. Opposite side wall 130 will reside in a vertical plane between legs 128 and 100. The bottom 70 of the enclosure 16 can be placed over the flat surface 34 of the hospital bed 12. The mattress 18 can then be placed onto the inner surface of the bottom 70 of enclosure 16. The head board 38 and the base board 36 will reside within the three-dimensional interior of the enclosure 16.

Importantly, as was stated herein previously, the hospital bed 12 is capable of pivotal movement so as to raise or lower the respective base board 36 and head board 38. So as to accommodate such pivotal moving, the material on the bottom 70 of the enclosure 16 will have a greater area than the area of a horizontal plane extending between the legs 30, 32, 100 and 128. This excess material will accommodate the pivotal movement of the hospital bed 12.

Figure 4:
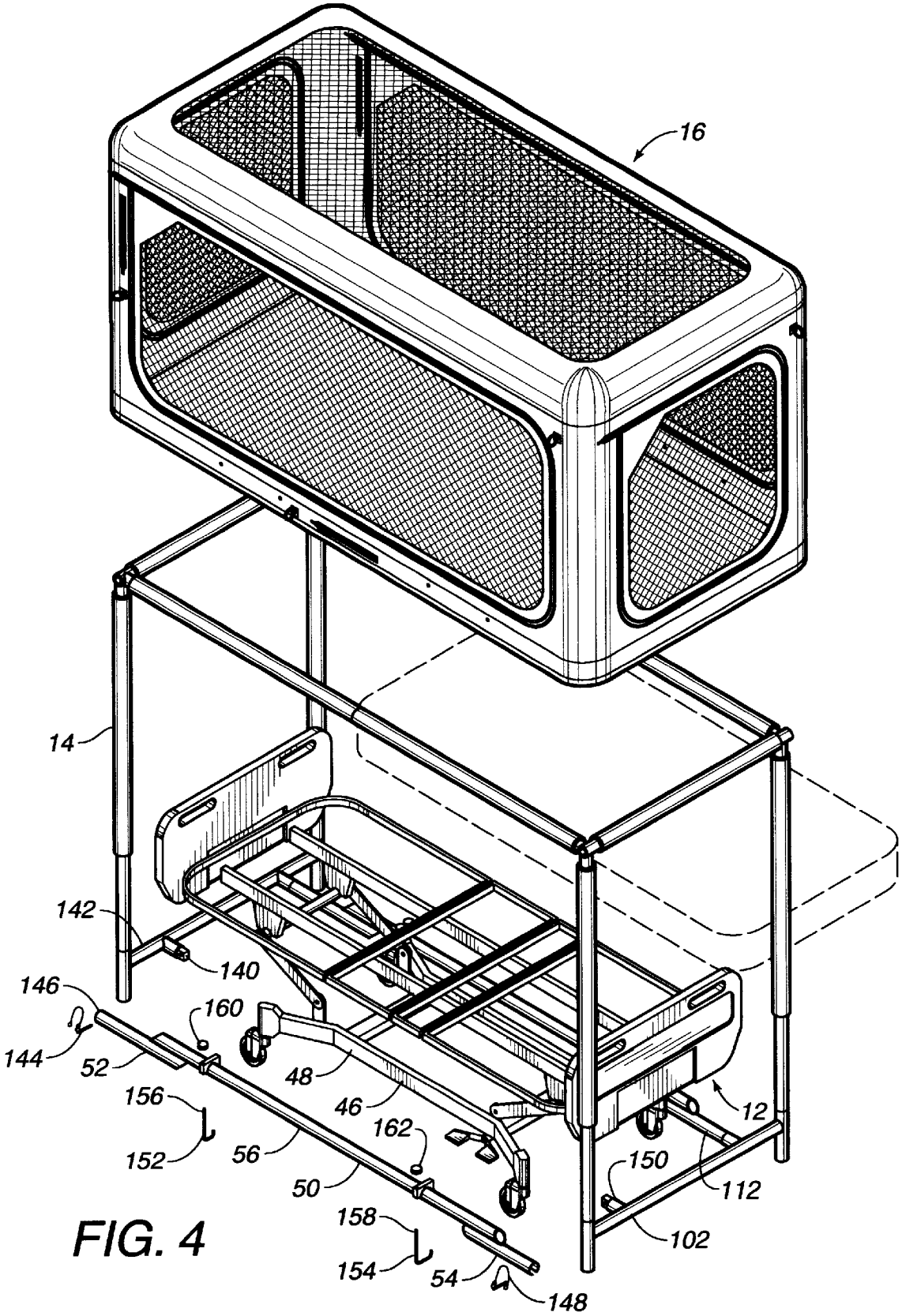
FIG. 4 is a further exploded upper perspective view of the enclosure bed in accordance with the teachings of the present invention.

In FIG. 4, the specific arrangement of the clamps which are used to secure the enclosure frame 14 to the hospital bed 12 is particularly illustrated. In particular, in FIG. 4, it can be seen that the longitudinal member 50 has its end sections 52 and 54. The central section 56 is welded onto the inner ends of the end sections 52 and 54 so as to overlie such end sections. This overlying relationship is necessary so that the central section 56 will be in a suitable position for residing onto the horizontal bar 48 of the bottom frame portion 46 of the hospital bed 12. The end section 52 can be secured to an arm 140 extending inwardly from the cross member 142 by the use of a pin 144. In other words, the opening at the end of the arm 140 can simply be slidably received within the open end 146 of the end section 52. When a hole on the end of end section 52 corresponds to the hole in the arm 140, the pin 144 can be inserted therein so as to securely mount the longitudinal member 50 onto the cross member 142. A similar arrangement is found in association with the opposite end section 54. A pin 148 can be used to secure the end section 54 onto the arm 150 extending inwardly from the cross member 102. A similar form of attachment applies to the other longitudinal member 112. Each of the longitudinal members 50 and 112 extends inwardly from the sides of the enclosure frame 14 so as to correspond in proper location with the bottom frame 46 of hospital bed 12.

The central section 56 of longitudinal member 50 is secured to the horizontal bar 48 through the use of brackets 152 and 154. Each of the brackets 152 and 154 has a L-shaped configuration. Each of the brackets 152 and 154 is a clamp which has a threaded end 156 and 158, respectively. The threaded ends 156 and 158 are inserted through respective holes formed in the central section 56 of longitudinal member 50. Nuts 160 and 162 are threadedly secured to the threaded portions 156 and 158 respectively, so as to suitably tighten the brackets 152 and 154 over and around the horizontal bar 48 of bottom frame 46. A similar arrangement occurs with respect to the other longitudinal member 112 with respect to its connection to the opposite horizontal bar associated with bottom frame 46 of hospital bed 12.

Figure 5:
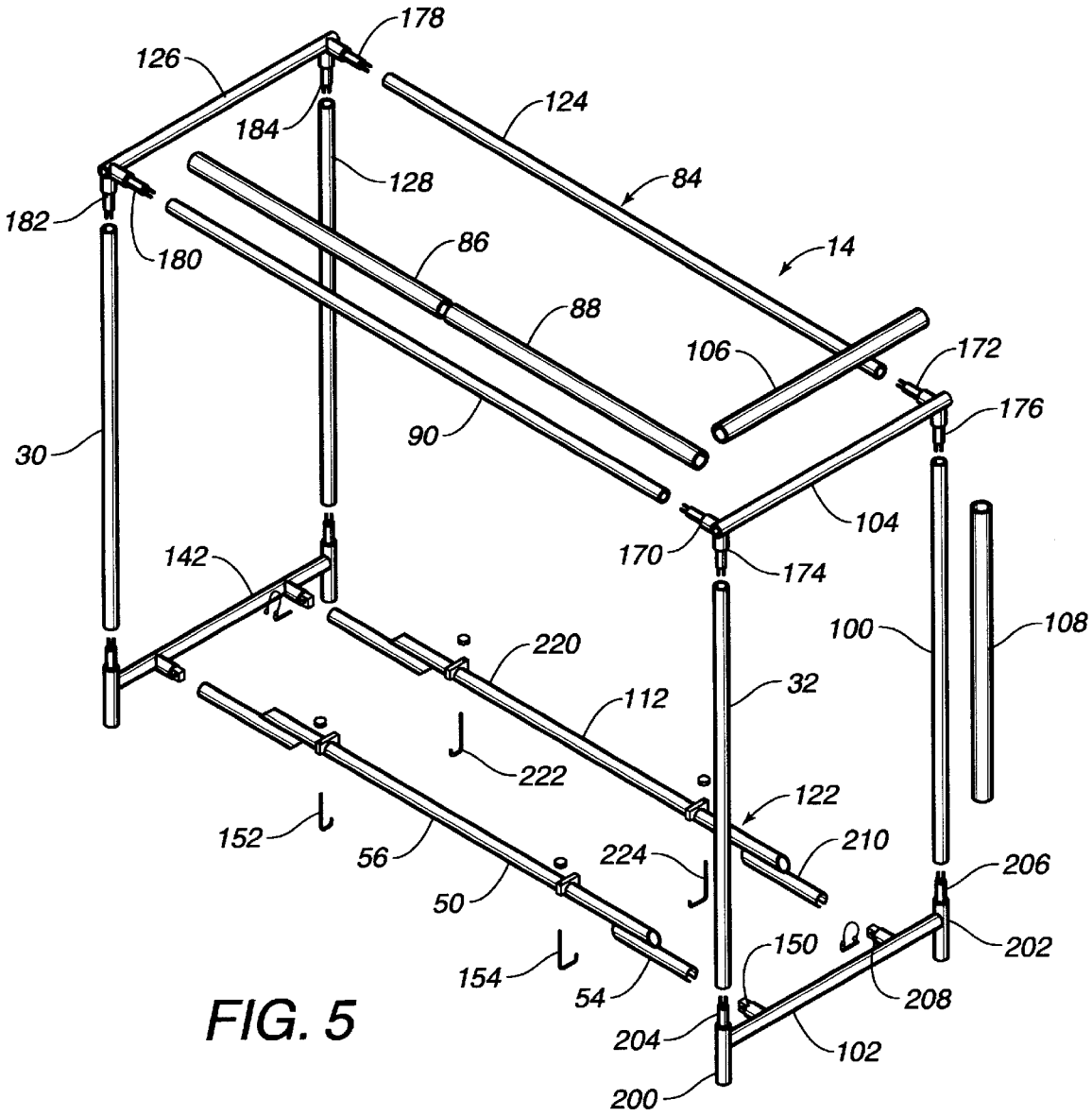
FIG. 5 is an isolated exploded upper perspective view showing the enclosure frame of the present invention.

FIG. 5 shows, in particular, the arrangement of the enclosure frame 14. Enclosure frame 14 includes the upper structure 84 and the lower portion 122. The upper structure 84 includes side bars 90 and 124 and end bars 126 and 104 connected together in a generally rectangular configuration. So as to facilitate assembly, the tubes which form the side bars 90 and 124 can be inserted into pins 170 and 172 formed at the respective ends of the end bar 104. Similarly, pins 174 and 176 can be inserted and affixed to the interior of the tubes which form the legs 32 and 100. Similarly, the end bar 126 also has pins 178 and 180 which can be inserted into the open ends of the tubes forming the side bars 90 and 124. Similarly, pins 182 and 184 can be inserted into the open ends of legs 30 and 128. As such, the upper structure 84 of the enclosure frame 14 can be easily assembled and connected together. Various fasteners can be used so as to securely retain the respective pins within the interiors of the respective tubes. As described herein previously, Styrofoam tubes 86 and 88 are fitted onto the side bar 90. Another Styrofoam tube 106 is fitted onto the end bar 104. A Styrofoam tube 108 is fitted onto the leg 100. The illustration of the Styrofoam tubes 86, 88, 106 and 108 is for the purpose of illustration. In actual practice, such Styrofoam tubes will be affixed also onto the end bar 126, onto the side bar 124 and onto the legs 30, 32 and 128.

The lower portion 122 of the enclosure frame 14 is made up of cross members 102 and 142. Cross member 102 is fixedly secured to the legs 32 and 100. So as to facilitate assembly, the cross member 102 has transverse seats for feet 200 and 202 affixed at opposite ends thereof. Foot 200 includes a pin 204 which can be affixed into the interior of the tube forming leg 32. Similarly, foot 202 has a pin 206 that can be received within the interior of the tube forming the leg 100. Arms 150 and 208 extend transversely outwardly from a side of the cross member 102 in a suitable position for connection to the end sections 54 and 210 of longitudinal members 50 and 112. The cross member 142 will have a similar construction so as to facilitate connection to the legs 30 and 128.

In FIG. 5, the longitudinal member 50 has its central section 56 in a position for receipt of the brackets 152 and 154. A similar arrangement applies to the central section 220 of longitudinal member 112. Brackets 222 and 224 can be affixed onto the central section 220 of longitudinal member 112. As such, the brackets 152, 154, 222 and 224 will be in a suitable position for engaging the horizontal bar 48 associated with the bottom frame 46 of hospital bed 12. Replacement of the brackets in this position assures the stability of the enclosure frame 14 once it is placed upon the frame of the hospital bed 12.

By allowing the enclosure bed apparatus 10 of the present invention to roll with the hospital bed, it is not necessary for specialized personnel to be called so as to facilitate either the disassembly of the enclosure bed or the transport of the enclosure bed. Also, it is not necessary to disassemble the enclosure bed for the purposes of moving a patient from one location or another. The patient can remain upon the same mattress during transport. Additionally, any danger from the patient can be avoided since the patient remains within the enclosure bed during transport.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

We claim:

1. An enclosure for attachment to a bed comprising:

a frame having legs and a lower portion;

said frame comprising, an upper structure having side bars and end bars arranged in a generally rectangular configuration, said upper structure being connected to said legs, said lower portion, comprising a lower structure connected to said legs and having a generally rectangular configuration and further comprising cross members affixed respectively to said legs at opposite ends of said frame; and longitudinal members affixed respectively to said cross members and extending therebetween in a generally parallel relationship, said longitudinal members positioned inwardly of sides of said frame;

a clamp affixed to said lower portion of said frame; said clamp adapted to affix said frame to the bed such that said legs have a bottom surface residing above a bottom of the bed; and a canopy affixed to said frame so as to define a three-dimensional space therein.

2. The enclosure of claim 1, said side bars and said end bars being detachably connected to said legs.

3. The enclosure of claim 1, each of said longitudinal members comprising:

a pair of end sections affixed to respective cross members and extending inwardly therefrom; and a central section affixed to said pair of end sections and overlying at least a portion of said end sections.

4. The enclosure of claim 1, said clamp comprising:

a pair of clamps connected to each of said longitudinal members, each of said plurality of clamps having a portion extending downwardly therefrom, said portion adapted to be secured to a frame of the bed.

5. The enclosure of claim 4, each of said pair of clamps being a generally L-shaped member having a threaded portion at one end, each of said pair of clamps having a nut engaging said threaded portion so as to compressively secure the L-shaped member against the respective longitudinal member.

6. An enclosure for attachment to a bed comprising:

a frame having legs and a lower portion;

a clamp affixed to said lower portion of said frame; said clamp adapted to affix said frame to the bed such that said legs have a bottom surface residing above a bottom of the bed; and a canopy affixed to said frame so as to define a three-dimensional space therein, said canopy having a plurality of side walls and a bottom and a top all connected together, said top extending over a top of said frame, said plurality of side walls affixed to said legs and extending respectively therebetween in a generally vertical plane, said bottom extending between said legs and above said lower portion in a generally horizontal plane.

7. The enclosure of claim 6, each of said plurality of side walls having a netting in zippered connection with a remainder of the side wall.

8. The enclosure of claim 6, at least one of said side walls having a zippered slit on an exterior surface of the side wall, said zippered slit selectively allowing access to said three-dimensional space interior of said canopy.

9. The enclosure of claim 6, said bottom of said canopy having a greater surface area than an area of the horizontal plane extending between said legs.

10. An enclosure bed apparatus comprising:

a bed having a mattress supported on a bed frame, said bed frame having wheels rotatably connected at a bottom thereof so as to rollably support said mattress on a floor;

an enclosure frame extending over said mattress, said enclosure frame having a lower portion and legs, said lower portion being affixed to said bed frame such that a bottom of said legs is supported a distance above a bottom of said wheels;

said lower portion comprising a lower structure connected to said legs having a generally rectangular configuration, said lower structure comprising:

cross members affixed respectively to said legs at opposite ends of said enclosure frame;

longitudinal members affixed respectively to said cross members and extending therebetween in a generally parallel relationship, each of said longitudinal members comprising:

a pair of end sections affixed to respective cross members and extending inwardly therefrom;

a central section affixed to said pair of end sections and overlying at least a portion of said end sections; and an enclosure affixed to said enclosure frame so as to extend over and around said mattress.

11. The apparatus of claim 10, further comprising:

a clamp connected to said lower portion of said enclosure frame, said clamp engaging said bed frame at an area below said mattress and above said wheels.

12. The apparatus of claim 10, said enclosure having a top and a plurality of side walls and a bottom, said bottom being interposed between said mattress and said bed frame.

13. The apparatus of claim 10, said enclosure frame comprising:

an upper structure having side bars and end bars arranged in a generally rectangular configuration, said upper structure being detachably connected to said legs.

14. The apparatus of claim 10, further comprising:

a pair of clamps connected to said central section of each of said longitudinal members, each of said pair of clamps having a portion extending downwardly therefrom, said portion being secured to said bed frame such that said bed frame is in compressive contact with said central section.

* * * * *